United States Patent [19]

Göhlert et al.

[11] 4,430,593

[45] Feb. 7, 1984

[54] ACOUSTIC TRANSDUCER

[75] Inventors: Christian Göhlert, Bergisch Gladbach; Peter Kanngiesser, Overath-Steinenbrück; Hansjakob Weiss, Bergisch Gladbach; Werner Wilke, Cologne, all of Fed. Rep. of Germany

[73] Assignee: Interatom, Internationale Atomreaktorbau GmbH, Bergisch Gladbach, Fed. Rep. of Germany

[21] Appl. No.: 217,408

[22] Filed: Dec. 17, 1980

[30] Foreign Application Priority Data

Dec. 19, 1979 [DE] Fed. Rep. of Germany ..... 2951075

[51] Int. Cl.[3] ..... H01L 41/08

[52] U.S. Cl. ..... 310/327; 310/334; 310/336; 73/644; 179/110 A

[58] Field of Search ..... 179/110 A; 181/151, 181/146, 158, 168, 180, 242, 198, 176; 73/644; 310/336, 334, 335, 327

[56] References Cited

U.S. PATENT DOCUMENTS

| | | | |
|---|---|---|---|
| 3,663,842 | 5/1972 | Miller | 310/334 |
| 3,757,888 | 9/1973 | Lagier | 181/198 |
| 3,783,967 | 1/1974 | Apgar | 181/198 |
| 3,973,152 | 8/1976 | Karplus | 73/644 |
| 4,196,631 | 3/1980 | De'om | 73/644 |
| 4,313,070 | 1/1982 | Fisher | 73/644 |

FOREIGN PATENT DOCUMENTS

| | | |
|---|---|---|
| 1648361 | 1/1972 | Fed. Rep. of Germany . |
| 1176103 | 4/1959 | France . |
| 7025131 | 3/1972 | France . |

*Primary Examiner*—G. Z. Rubinson
*Assistant Examiner*—L. C. Schroeder
*Attorney, Agent, or Firm*—Herbert L. Lerner; Laurence A. Greenberg

[57] ABSTRACT

Acoustic transducer having a piezo-electric element, including a lead section connected to the piezo-electric element, the lead section being in the form of a metallic body having a high specific attenuation.

12 Claims, 6 Drawing Figures

ACOUSTIC TRANSDUCER

The present invention relates to an acoustic transducer for transmitting and receiving sonic and in particular ultrasonic signals, including a piezo-electric element, lead section and a damping body. With the exception of the piezo-electric element, this acoustic transducer can be made completely of metal and is therefore particularly well suited at high temperatures and/or under radioactive radiation exposure. With these transducers, objects in opaque liquids, such as for instance liquid sodium, etc. can be tested or surfaces can be scanned without contact. The so-called advance or lead section protects the piezo-electric element against wear or against contact with an aggressive medium and can, with suitable shape, change the direction of the sound. In customary ultrasonic material tests at room temperature and in air atmosphere, plastic wedges which have a wave impedance suitable for this purpose are used as lead sections.

The wave impedance of two adjacent media or bodies determines the reflection at the boundary surfaces of these media and is always the product of the density and the sound velocity of a medium. A lead section should have a wave impedance which is between that of the two adjoining media. In the ideal case, a lead section should have a wave impedance which is the geometric mean between the wave impedances of the two adjoining media. Some plastic materials have a wave impedance suitable for material testing, others are given a suitable wave impedance through the addition of tungsten powder for instance. However, all plastic materials have the disadvantage that they are not suitable at higher temperatures and under radiation exposure. Their surface is damaged when moved on rough workpieces. Their thermal coefficient of expansion deviates considerably from that of the piezo-electric elements used, so that temperature changes can alter the connection between the plastic material and the element. The metals and ceramic materials suitable for high temperature, radiation exposure and/or aggressive media, however, have a high wave impedance which is not advantageous for this purpose.

Furthermore, contactless scanning and observation of workpieces which are in opaque media is a problem particularly for liquid-cooled nuclear power plants. In these plants, it is undesirable to drain the coolant, for instance sodium, for observing the parts of the plant, because on the one hand the reactor is then no longer sufficiently well cooled and on the other hand, the amount of liquid metal sticking to the plant parts to be checked make observation more difficult. Additionally, liquid metal compounds are produced upon contact with the oxygen contained in the air or the air moisture, which likewise make observation more difficult and also have an aggressive action. It has therefore already been proposed to measure distances without contact in sodium with ultrasound similar to underwater echo sounding.

In German Published Non-Prosecuted Application DE OS No. 26 14 376.0, an ultrasonic transducer for high temperatures, for instance for a liquid-metal-cooled nuclear reactor, is described. The coupling which is proposed there includes a multiplicity of thin metal plates which are held together under pressure and have an optically smooth surface toward the piezo-electric element. Such a wedge of numerous thin laminations, however, can be made only at considerable cost and must be continuously pressed together under considerable pressure so that the liquid metal does not seep through the gaps and attack the piezo-electric element. In addition, a wedge made from numerous thin laminations has the disadvantage that the conduction of the sound depends on the direction of these laminations.

In German Published Non-Prosecuted Application DE OS No. 24 36 328.8, a damping body is described which may include a loose wire fabric or a mixture of rubber and tungsten powder. However, rubber is neither temperature nor radiation resistant and the wire fabric cannot be loaded mechanically.

It is accordingly an object of the invention to provide an acoustic transducer which overcomes the hereinafore-mentioned disadvantages of the heretofore-known devices of this general type, and is suitable at high temperatures and/or under radioactive radiation exposure as well as in aggressive media.

With the foregoing and other objects in view there is provided, in accordance with the invention, an acoustic transducer having a piezo-electric element, comprising a lead section and/or damping body connected to the piezo-electric element, the lead section and/or damping body being in the form of a metallic body having a high specific attenuation.

Metallic bodies with high specific damping have a wave impedance which is substantially lower than in customary metallic bodies, because the sound velocity is considerably lower in them. Particularly the feature of porosity, for instance, in sintered materials reduces the velocity of sound, the overall pore volume being the controlling factor therein. If the pore dimensions are chosen smaller than the ultrasonic wavelength, the sound attenuation caused by scattering becomes small as compared to material-related sound attenuation. The pore volume can be practically adjusted by the grain size of the metal powder.

In accordance with another feature of the invention, the metallic body is porous and can be prepared in various ways. The most practical appear at the present time to be porous bodies of so-called sintered metal. Therefore, in accordance with a further feature of the invention, the metallic body is formed of a sintered metal. This sintered metal of corrosion-resistant, heat-resistant material is made under high pressure and high temperature from metal powder of small grain size. This homogeneous sintered metal conducts the sound equally well in all directions, and is therefore suitable for acoustic lenses or wedges too in which the sound waves are to propagate in different directions. Acoustical lenses are bodies in lens form which actually concentrate or disperse the sound, similarly to optical lenses.

Advance sections of sintered metal are not only temperature-and radiation-resistant but also have advantages at room temperature over the known plastic materials. This is because they are not only more wear-resistant but also less sensitive to minor damage to their surface. It has been found that the porous sintered-metal surface can be substantially more reliably coupled with the customary oil to a rough workpiece surface than the smooth plastic material surface. Sintered metals also have further advantages at the temperatures which are still permissible for plastic materials, because their coefficients of expansion approximately correspond to those of the piezo-electric elements and to those of the materials to be tested and therefore the reflection at boundary surfaces is not substantially changed even at higher temperatures. Sintered metals having pore dimensions which are larger than those of the lead section are suitable for damping bodies.

As an alternative for the choice of the material, in accordance with an added feature of the invention, the metallic body is formed of an iron-chromium-aluminum alloy. Alloys of iron, chromium and aluminum can be produced with high specific damping capability, so that they are suitable for use as damping material in acoustic transducers. A lead section of such material need not be sealed and likewise meets the requirements as to temperature behavior, radiation resistance and mechanical strength.

In accordance with an additional feature of the invention, particularly for material testing, the lead section is in the form of at least one i.e. 1 or 2 wedge-shaped lead sections each having two sound interfaces being inclined relative to each other and having a space formed therebetween as well as having other surfaces, and the metallic body is formed of a sintered metal being of different grain sizes including relatively smaller grain size in the space and relatively larger grain size in vicinity of the other surfaces.

This transducer avoids interfering reflections within the lead section at the surfaces not serving for passing the sound. By an arrangement of sintered metal with different grain sizes, the sound can be locally attenuated differently. Between the two sound interfaces, the sintered metal body has essentially a smaller grain size, so that the sound is passed with little attenuation from one to the other surface. In the vicinity of the other surfaces, the sintered metal has a larger grain size and an accordingly larger pore volume, so that the sound is attenuated more in this region through higher absorption.

In accordance with yet another feature of the invention, the lead section has a base surface disposed opposite the piezo-electric element, and the metallic body is formed of sintered metal being substantially or quasi-continuously decreased in grain size from the base surface to the piezo-electric element. This transducer can be largely matched on both sides to the adjacent material or media. On the side of the liquid medium, i.e. liquid metal or water, for instance, a lower wave impedance can be adjusted through a larger grain size of approximately 50 to 100 μm, and on the side of the piezo-electric element a higher wave impedance can be adjusted by a smaller grain size of about 20 μm. With such matching, the reflections occurring at a boundary layer of two media are considerably reduced and the performance of the transducer is enhanced thereby.

In accordance with yet a further feature of the invention, the damping body has a rear surface disposed opposite the piezo-electric element, and the metallic body is formed of sintered metal being increased in grain size from the piezo-electric element to the rear surface. This transducer is to be damped mechanically in order to obtain transmitting pulses that are as short as possible, so that the piezo-electric element can transmit or receive sound waves without losses as far as possible, i.e. without reflections not only on the side facing the object to be investigated, but also absorbing sound waves on its damped rear side as far as possible and without reflections. In order to avoid reflections at the boundary surface between the piezo-electric element and the damping body, it is on the one hand advantageous to use at this point a material having a wave impedance which as far as possible corresponds to that of the piezo-electric element. For elements of lead zirconate-titarate, lead methaniobate or lithium niobate, a sintered metal of small grain size of about 100 to 200 μm is suitable at this point. However, a damping body of such a material would have to have considerable dimensions in the direction of the sound in order to obtain sufficient damping. On the other hand, maximum attenuation with minimum reflection is obtained in a damping body in which the grain size of the sintered metal increases continuously in the direction from the piezo-electric element toward the rear side of the damping body. In practice, however, it seems sufficient to dispose two or three different grain sizes in a damping body. The largest grain size for damping bodies should be approximately 0.3 mm=300 μm.

In accordance with yet an added feature of the invention, the metallic body has at least one sealed side.

In accordance with yet an additional feature of the invention, the at least one sealed side is ground, i.e. is sealed by grinding. In accordance with again another feature of the invention, the at least one sealed side is borated, i.e. is sealed by borating. These porous metallic bodies proposed are suitable for contact with such aggressive materials which are in a position to attack the piezo-electric element. It has been found that such superficial sealing of the sintered metal body does not interfere with the desired acoustic properties. Coating by electro-deposition or applying solder to the surface has been found to be impractical, because in the one case the electroplating liquid, and in the other case a residue of the soldering agent, remains in the fine pores of the sintered metal and causes corrosion therein. It has been found that a sintered metal of alloy steel can be sealed by grinding with a diamond tool. The numerous projections of the sintered metal are pushed in this manner into the adjacent depressions and voids and seal these off. Furthermore, by borating, i.e. coating with a boron-containing material and subsequent extended annealing at about 900° C., machined steel surfaces can be hardened and sealed by iron boride which is produced in the structure conversion.

In accordance with a concomitant feature of the invention, there are provided metallic foils of small thickness (approximately $\frac{1}{4}$ of the wave length) sealing the at least one side. Such a body with metallic foils as the seal has a better wave impedance matching if certain foil densities are observed (approximately $\frac{1}{4}$ of the wave lengths), since the foil has an effect comparable to an optical interference filter. Depending on the ambient medium, aluminum, magnesium, alloy and others can be considered as materials. An application by diffusion welding also avoids disadvantages such as occur in soldering. For protection against an aggressive medium and to promote wetting, the foils can be coated or vapor-deposited with a rare metal, for instance gold.

Other features which are considered as characteristic for the invention are set forth in the appended claims.

Although the invention is illustrated and described herein as embodied in an acoustic transducer, it is nevertheless not intended to be limited to the details shown, since various modifications and structureal changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
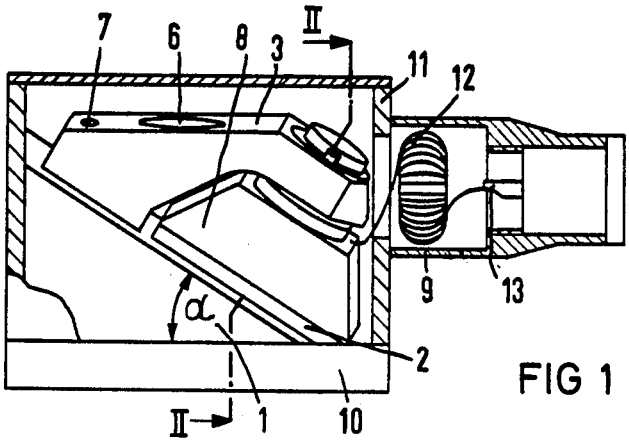
FIG. 1 is a diagrammatic side view, partly in cross section and partly broken away, of an acoustic transducer for determining material faults in materials.
Figure 2:
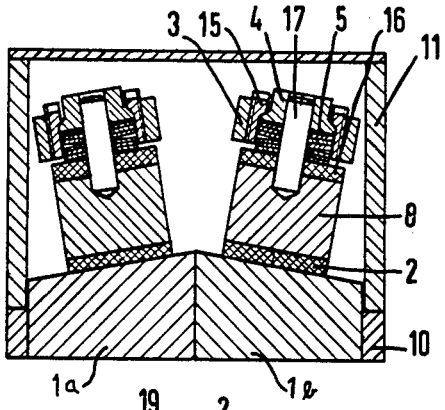
FIG. 2 is a cross-sectional view of FIG. 1, taken in the direction of the arrows.

Referring now to the figures of the drawing, and first particularly to FIGS. 1 and 2 therreof, it is seen that separate transmitters and receivers are used therein.

The advance or lead section 1 of sintered metal or a metal of high specific damping includes two separate wedge halfs 1*a* and 1*b*. The angle $\alpha$ of the lead section is specially chosen for material testing so that the sound incidence angle in the material, depending on the sound velocities in the lead section of the wedge as well as in the material to be tested has a fixed value which is between 45° and 70°. Actually constructed lead sections have wedge angles between 24° and 35° for longitudinal waves.

The surfaces provided for receiving the piezo-electric transducer 2 are optically smooth and are lapped to less than 1 micron waviness. The contact pressure device 3 is formed of stainless steel and contains an adjustable pressure piece 4 for receiving cup springs 5 formed of temperature resistant material. The contact pressure is 40 to 60 kg/cm$^2$. The contact pressure device 3 is fastened by a screw 6 and a bolt 7 on the lead section 1. The pressure of the cup springs 5 is transmitted to a metallic damping body 8 of high specific attenuation. The pressure is uniformly transmitted to the piezo-electric element 2 through the mechanically strong damping body 8. The contact surface of the damping body 8 is likewise machined by lapping to an accuracy of less than 1 micron. Foils of gold or other ductile and temperature-resistant materials can be used for coupling the piezo-electric element 2. Electric contact is through a signal conductor 9, connected to the metallic damping body 8, as well as through the lead section 1 to ground. The two parts of the lead section 1 are fitted into a frame 10 of alloy steel. The housing 11 is fastened on the frame 10 and constructed in such a way that it can receive the coil 12 for the electrical balancing for each piezo-electric element 2 as well as the connecting jacks 13 for the measuring cables.

As shown in the cross section through the transducer according to the invention from FIG. 1, the inclination of the two adapter-wedge halves 1*a* and 1*b* is chosen in such a manner that the piezo-electric elements 2 can be focused for material testing. The contact pressure device 3 for supplying a defined contact pressure contains a fine thread for receiving a setscrew 15. The set screw 15 has a conical seating surface for the pressure piece 4, which supplies the pressure to the damping body 8 though the cup springs 5 as well as through a washer 16 formed of insulating material. The pin 17 is likewise made of insulating material and serves to maintain the position of the damping body 8 during assembly. Defined pressure is supplied from the outside to the pressure piece 4. Subsequently, the setscrew 15 is tightened. Since the contact pressure device 3 has no elasticity of its own due to proper construction, the force of the cup springs 5 can be braced against it. A gap is provided between the two adapter-wedge halves 1*a* and 1*b*, which prevents passage of the sound waves.

Figure 3:
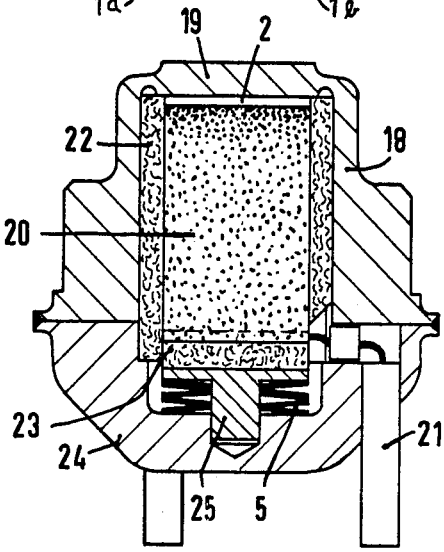
FIG. 3 is a diagrammatic cross-sectional view of an acoustic transducer which simultaneously serves as a transmitter and receiver.

In FIG. 3, the transducer includes a housing 18, one side of which is constructed as a sound diaphragm 19. The element 2 is applied on the inside of the sound diaphragm 19. In the same manner, the damping body 20 which is formed of sintered metal or a metal of high specific attenuation, is connected to the rear side of the element 2. The joining technique is adapted to the respective operating temperatures.

The cup springs 5 prevents the damping body 20 from being lifted off the element 2 in the event of unfavorably occurring vibrations. The damping body 20 simultaneously serves as an electrical connecting member and is connected in a conducting manner to a temperature-resistant coaxial line 21. Through the ceramic insulators 22 and 23, a metallic separation between the damping body 20 and the housing 18 is obtained. The housing 18 is sealed by means of a lid 24 which also serves as an abutment for the cup springs 5 which are centered by the bolts 25.

Figure 4:
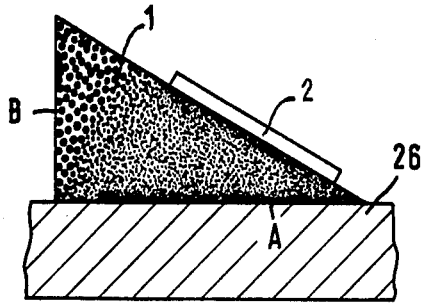
FIG. 4 is a diagrammatic, fragmentary cross-sectional view of a wedge as lead section of a transducer which is made of sintered matal of different grain sizes.

FIG. 4 shows a diagrammatic view of a wedge 1 as the lead section of an ultrasonic transducer according to claim 3. The piezo-electric element 2 is attached to the upper side of the wedge. The wave fronts emanating from the element 2 propagate in the wedge as plane waves along straight lines.

If the surface A is coupled to a body 26 to be tested, only part of the sound energy travels into this body; the other part of the sound energy is reflected at the boundary surfaces in the direction of the surface B, the refleation angle being equal to the angle of incidence of the sound waves. In the region of the surface B, a metal powder with larger grain sizes, such as a grain size of 200 to 300 microns is arranged, which causes increased sound absorption. The other regions of the wedge contain a homogeneous material with metal power of, for instance, 100 to 200 micron grain size with a constant and low sound attenuation. The transition surface between different grain sizes can be arranged at a defined angle relative to the surface B. The transition from large grain to fine grain material by a mixing process during the manufacture is fluid, so that there is no sharply defined boundary surface with interfering reflection behavior.

Figure 5:
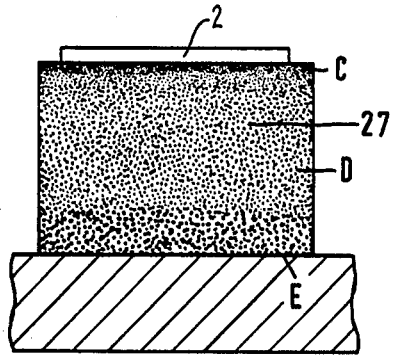
FIG. 5 is a view similar to FIG. 4 of a lead section of sintered metal of different grain sizes.

In FIG. 5, the lead section 27 in the region of the piezo-electric element 2 is constructed with a homogeneous layer C of small grain size; the region D is formed of material with larger grain size and the region E again is characterized by a layer of even larger grain size.

Figure 6:
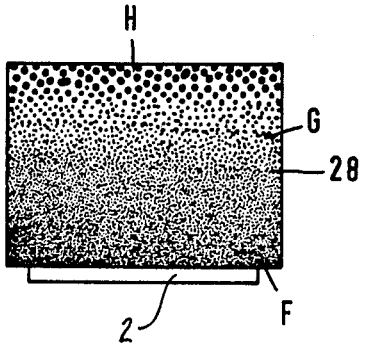
FIG. 6 is a diagrammatic front elevational view of a damping body of sintered metal with different grain sizes.

FIG. 6 shows a damping body 28 of sintered metal of different grain sizes. In the region F of the firmly coupled piezo-electric element 2, the grain is chosen so that a sound wave impedance is obtained which is matched as far as possible to the piezo-electric material. In the region G, the grain size of the sintered metal is chosen so large that a sufficiently high attenuation is brought about and back-wall echoes from the surface H are practically no longer reflected to the piezo-electric element 2.

The metallic body forming the lead section and/or the damping body may be porous and may be sealed at least at one side thereof, such as by grinding its surface, by borating or by using metallic foils of small thickness, i.e. approximately $\frac{1}{4}$ of the same length. The metallic body may be formed of an iron-chromium-aluminum alloy.

There are claimed:

1. Acoustic transducer having a piezo-electric element, comprising a lead section having a region connected to a piezo-electric element having a given surge impedance and said lead section having another region for coupling to a medium to be tested having another given surge impedance, said lead section being in the form of a metallic body having pores formed therein and having a sound interface, the number and size of said pores being adjusted for providing a surge impedance in vicinity of said sound interface being between the surge impedances of the piezo-electric element and the medium to be coupled thereto.

2. Acoustic transducer having a piezo-electric element, comprising a damping body having a region connected to a piezo-electric element having a given surge impedance and said lead section having another region for coupling to a medium to be tested having another given surge impedance, said damping body being in the form of a metallic body having pores formed therein and having a sound interface, the number and size of said pores being adjusted for providing a surge impedance in vicinity of said sound interface being between the surge impedances of the piezo-electric element and the medium to be coupled thereto.

3. Acoustic transducer according to claim 1 or 2, wherein said metallic body is fromed of a sintered metal.

4. Acoustic transducer according to claim 1, wherein said lead section is in the form of at least one wedge-shaped lead section each having two sound interfaces being inclined relative to each other and having a space formed therebetween as well as having other surfaces, and said metallic body is formed of a sintered metal being of different grain sizes including relatively smaller grain size in said space and relatively larger grain size in vicinity of said other surfaces.

5. Acoustic transducer according to claim 1, wherein said lead section has a base surface disposed opposite said piezo-electric element, and said metallic body is formed of sintered metal being substantially continuously decreased in grain size from said base surface to said piezo-electric element.

6. Acoustic transducer according to claim 2, wherein said damping body has a rear surface disposed opposite the piezo-electric element, and said metallic body is formed of sintered metal being increased in grain size from the piezo-electric element to said rear surface.

7. Acoustic transducer according to claim 1 or 2, wherein said metallic body has at least one sealed side.

8. Acoustic transducer according to claim 7, wherein said at least one sealed side is ground.

9. Acoustic transducer according to claim 7, wherein said at least one sealed side is borated.

10. Acoustic transducer according to claim 7, including metallic foils of small thickness sealing said at least one side.

11. Acoustic transducer according to claim 1, including a damping body connecting said metallic body to the piezo-electric element.

12. Acoustic transducer according to claim 1 or 2, wherein the magnitude of the surge impedance of said metallic body is substantially the geometric mean between the surge impedances of the piezo-electric element and the medium.

* * * * *